US006237680B1

(12) United States Patent
Davis

(10) Patent No.: US 6,237,680 B1
(45) Date of Patent: May 29, 2001

(54) LAMINAR FLOW RADIATOR FOR MOTOR VEHICLE

(76) Inventor: Ronny L. Davis, 7334 N. 108$^{th}$ Ave., Glendale, AZ (US) 85307

( * ) Notice: Subject to any disclaimer, the term of this patent is extended or adjusted under 35 U.S.C. 154(b) by 0 days.

(21) Appl. No.: 09/288,483

(22) Filed: Apr. 8, 1999

(51) Int. Cl.$^{7}$ ..... F28D 1/047
(52) U.S. Cl. ..... 165/176; 165/144; 165/145
(58) Field of Search ..... 165/176, 144, 165/145, 152

(56) References Cited

U.S. PATENT DOCUMENTS 5,172,752 * 12/1992 Goetz, Jr. ..... 165/41

FOREIGN PATENT DOCUMENTS 2.222.623 * 10/1974 (FR) ..... 165/176
63-282490 * 11/1988 (JP) ..... 165/176
4-189 * 1/1992 (JP) ..... 165/176

* cited by examiner

*Primary Examiner*—Allen Flanigan
(74) *Attorney, Agent, or Firm*—Tod R. Nissle, P.C.

(57) ABSTRACT

A radiator utilizes laminar flow to more efficiently cool a liquid coursing through the radiator. The radiator spaces a pair of cores a sufficient distance apart to produce laminar flow between the cores.

2 Claims, 3 Drawing Sheets

FIG. 1
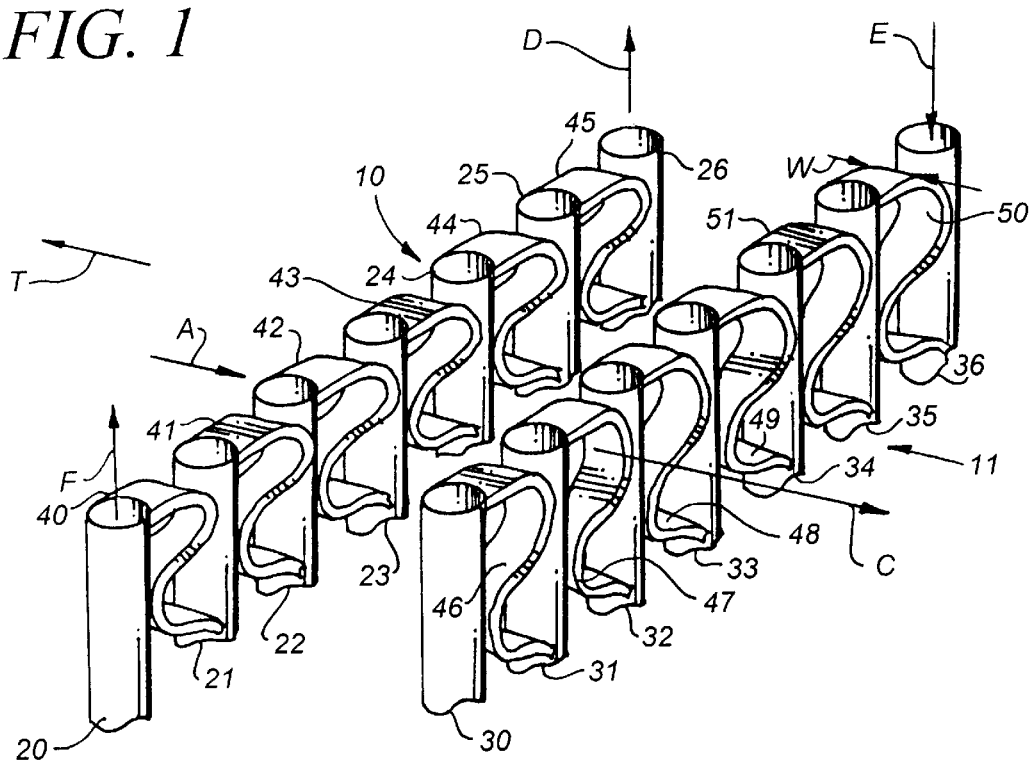
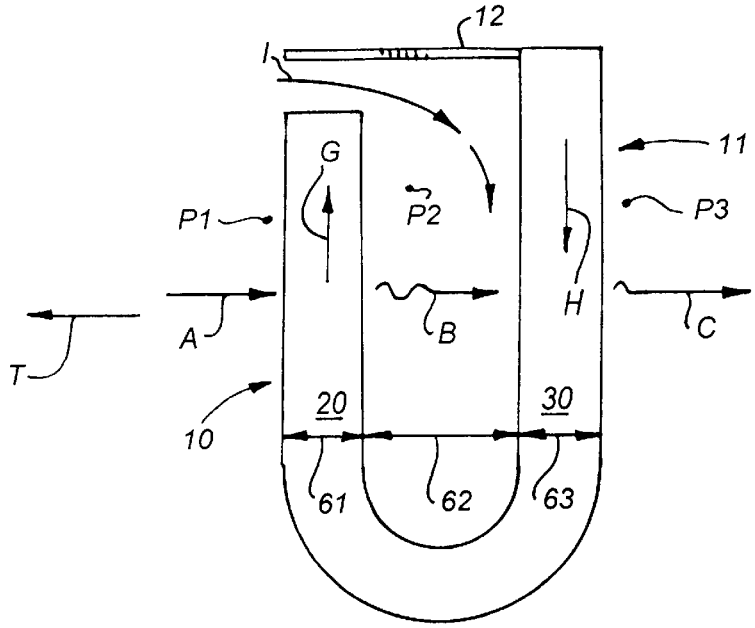
FIG. 2

LAMINAR FLOW RADIATOR FOR MOTOR VEHICLE

This invention relates to apparatus for cooling an internal combustion engine.

More particularly, the invention relates to a radiator which utilizes laminar flow to more efficiently cool a liquid coursing through the radiator.

The utilization of a radiator as a heat exchange apparatus for a vehicle is well known in the art. A radiator receives coolant. The coolant courses through the jacket of an internal combustion engine and absorbs heat from the engine. The coolant travels to the radiator. The radiator removes heat from the coolant before the coolant travels back to the engine to remove heat from the engine. One objective of designing a radiator is to insure that the radiator operates efficiently in removing heat from coolant.

It therefore would be highly desirable to provide an improved radiator which would function more efficiently than conventional radiators in removing heat from coolant.

Therefore, it is a principal object of the invention to provide an improved radiator for an internal combustion engine.

A further object of the invention is to provide a radiator which produces a laminar air flow to improve the thermodynamic efficiency of a radiator.

Another object of the invention is to provide a radiator which minimizes the influence of air in reducing the thermodynamic efficiency of the radiator.

These and other further and more specific objects and advantages of the invention will be apparent to those skilled in the art from the following detailed description thereof, take in conjunction with the drawings, in which:

FIG. 1 is a perspective view illustrating a vehicle radiator constructed in accordance with the principles of the invention;

FIG. 2 is a front view of the radiator of FIG. 1 illustrating a air flow guide plate which can be incorporated in the invention;

Figure 3:
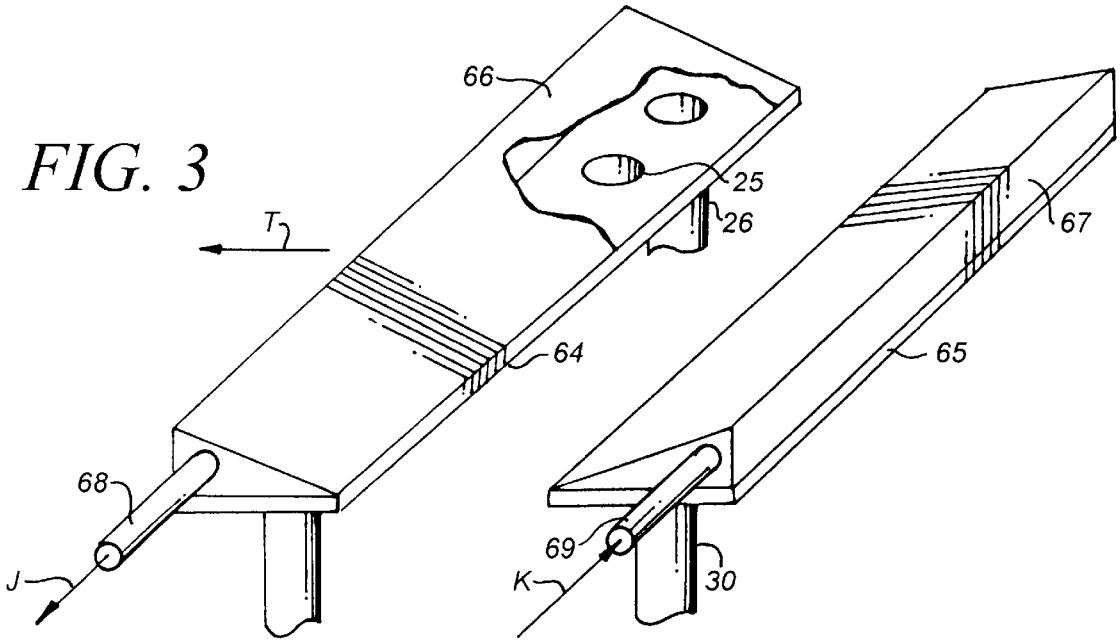
FIG. 3 is a perspective view illustrating the vehicle radiator of FIG. 1 including plates and plenums for directing coolant into and receiving coolant from the conduits of FIG. 1.

Briefly, in accordance with my invention, I provide an improved radiator. The radiator is mounted on a motor vehicle which includes a frame; a prime mover mounted on the frame; a coolant; and, a circulation system for moving the coolant adjacent the prime mover to absorb heat from the prime mover. The improved radiator receives coolant from the circulation system and removes heat from the coolant. The radiator includes a first heat transfer section to receive coolant from the circulation system. The first heat transfer section includes at least one conduit for receiving coolant and includes a plurality of fins contacting and extending outwardly from the conduit. The radiator also includes a second heat transfer section which is in fluid communication with the first heat transfer section to receive coolant from the first heat transfer section. The second heat transfer section includes at least one conduit for receiving coolant and a plurality of fins contacting and extending outwardly from the conduit. The fins on the first section are shaped and dimensioned and the second section is spaced apart from the first section such that air flowing turbulently out of the first heat transfer section toward the second heat transfer section resumes laminar flow prior to entering the second heat transfer section.

In another embodiment of the invention, I provide a method of transferring heat in a motor vehicle. The motor vehicle includes a frame; a prime mover mounted on the frame to provide when operated motive power to move the vehicle; a coolant; and, a circulation system for moving the coolant adjacent the prune mover to absorb heat from the prime mover. The method includes the step of providing a radiator for receiving coolant from the circulation system and removing heat from the coolant. The radiator includes a first heat transfer section to receive coolant from the circulation system. The first heat transfer section includes at least one conduit for receiving coolant and includes a plurality of fins contacting and extending outwardly from the conduit. The radiator also includes a second heat transfer section which is in fluid communication with the first heat transfer section to receive coolant from the first heat transfer section. The second heat transfer section includes at least one conduit for receiving coolant and a plurality of fins contacting and extending outwardly from the conduit. The fins on the first section are shaped and dimensioned and the second section is spaced apart from the first section such that air flowing turbulently out of the first heat transfer section toward the second heat transfer section resumes laminar flow prior to entering the second heat transfer section. The method also includes the steps of mounting the radiator on the vehicle to receive coolant from the circulation system; and, operating the prime mover to cause the vehicle to move such that the movement of the vehicle causes air to flow into and through the first heat transfer section, and from the first heat transfer section into and through the second heat transfer section.

Turning now to the drawings, which depict the presently preferred embodiments of the invention for purposes of illustrating the invention and not by way of limitation of the scope of the invention, and in which like reference characters refer to corresponding elements throughout the several views, FIG. 1 illustrates the conduits 20 to 26 and 30 to 36 comprising a radiator constructed in accordance with the invention. Conduits 20 to 26 are in the front portion 10 of the radiator. Conduits 30 to 36 are in the read portion 11 of the radiator.

Conduit 20 is connected to conduit 30 in the manner illustrated in FIG. 2 to form interconnected conduit pair 20-30. Water-antifreeze solution (or another coolant) flowing into conduit 30 travels through conduit 30, from conduit 30 into and through conduit 20, and exits from conduit 20 in the direction indicated by arrow F in FIG. 1. In a similar manner conduit 36 is connected to conduit 26 and forms interconnected conduit pair 36-26. The shape and dimension of conduit pair 26-36 is identical to that of conduit pair 20-30. Water-antifreeze solution flowing into conduit 36 in the direction of arrow E flows through conduit 36, from conduit 36 into and through conduit 26, and exits from conduit 26 in the direction of arrow D in FIG. 1. Conduit pair 26-36 is parallel to conduit pair 20-30.

The radiator of FIG. 1 also includes conduit pairs 31-21, 32-22, 33-23, 34-24, and 35-25. Each of these conduit pairs is identical in shape and dimension to conduit pair 30-20. Water-antifreeze solution flowing into conduits 31 to 35 flows into, through, and out of conduits 21 to 25, respectively, in the same manner that water-antifreeze solution flows into and through conduit pair 20-30. Each conduit pair 30-20, 31-21, 32-22, 33-23, 34-24, 35-25, and 36-26 is parallel to the other conduits pairs and is spaced apart from its adjacent conduit pair(s).

Serpentine fin 40 extends between and interconnects spaced apart conduits 20 and 21. Serpentine fin 41 extends between and interconnects spaced apart conduits 21 and 22. Serpentine fin 42 extends between and interconnects spaced apart conduits 22 and 23. Serpentine fin 43 extends between and interconnects spaced apart conduits 23 and 24. Serpentine fin 44 extends between and interconnects spaced apart conduits 24 and 25. Serpentine fin 45 extends between and interconnects spaced apart conduits 25 and 26. Serpentine fin 46 extends between and interconnects spaced apart conduits 30 and 31. Serpentine fin 47 extends between and interconnects spaced apart conduits 31 and 32. Serpentine fin 48 extends between and interconnects spaced apart conduits 32 and 33. Serpentine fin 49 extends between and interconnects spaced apart conduits 33 and 34. Serpentine fin 51 extends between and interconnects spaced apart conduits 34 and 35. Serpentine fin 50 extends between and interconnects spaced apart conduits 35 and 36. The shape and dimension of each fin 40 to 51 can vary as desired. By way of example, and not limitation, the fins 40 to 51 shown in FIG. 1 each have a width, indicated by arrows W, which is about equal to the outer diameter of a conduit 20 to 26, 30 to 36. The width W can be greater or less than the diameter of each conduit 20 to 26, 30 to 36. The width (or thickness, etc.) of a fin 40 to 51 need not be constant along the entire length of the fin.

Fins 40 to 45 are in the front portion of the radiator. Fins 46 to 51 are in the read portion of the radiator. As described above, water-antifreeze solution preferably flows into conduits 30 to 36 in the rear portion 11 of the radiator and then flow from the rear portion 11 into conduits 20 to 26 in the front portion 10 of the radiator. The rear portion 11 of the radiator is spaced apart from the front portion 10 by a distance indicated in FIG. 2 by arrows 62. The rear portion 11 is presently preferably (but not necessarily) parallel to front portion 10 of the radiator.

The coolant which flows into the rear portion 11 ordinarily carries heat which it has absorbed by traveling adjacent the prime mover of a vehicle in conventional fashion. When the vehicle is traveling in the direction indicated by arrow T in FIGS. 1 to 3, air is forced in the direction of arrow A into and through openings in fins 40 to 45 in the front portion 10 of the radiator. Or, a fan or other means can cause air to flow through front portion 10 in the direction of arrow A. Air exiting front portion 10 and travels toward rear portion 11 in the direction of arrow B. Air leaving front portion 10 ordinarily is subject to turbulent flow conditions but gradually resumes laminar flow as it nears rear portion 11. Distance 62 must be great enough to permit air exiting front portion 10 to resume laminar flow. Distance 62 is presently in the range of about 0.75 inch to six inches. The shape and dimension of fins 40 to 51 is critical in determining the minimal allowable distance 62 between front portion 10 and rear portion 11. Fins which produce a strong turbulent air flow exiting portion 10 toward portion 11 require a greater distance 62 for the air to resume laminar flow.

Air entering portion 11 passes therethrough and exits in the direction of arrow C. Air exiting portion 11 experiences turbulent flow and then, as the distance of air from portion 11 increases, begins to approach or experience laminar flow.

One advantage of the radiator of the invention is that the pressure drop experienced in traversing the radiator is reducing in comparison to a convention "one wall" radiator. A conventional single wall or single portion radiator can have an air pressure of thirty pounds per square inch (psi) at the front of the radiator where air is flowing into the radiator, and can have an air pressure of fifteen psi at the rear of the radiator where air is exiting the radiator. In comparison, if portion 10 has a thickness indicated by arrows 61 of one inch, if distance 62 is one and one-half inches, and if portion 11 has a thickness indicated by arrows 63 of one inch, then the pressure at point P1 can be thirty psi, the pressure at point P2 can be twenty-six psi, and the pressure at point P3 can be twenty-two psi.

An elongate panel or plate 12 can be secured to the top of rear portion 11 in the manner illustrated in FIG. 2 in order to cause air to flow intermediate portions 10 and 11 along the path indicated by arrows I.

Plate 64 and member 66 form a plenum on the front portion 10. This plenum receives cooled water-antifreeze exiting conduits 20 to 26. The water-antifreeze travels from the plenum into conduit 68 and back to the prime mover as indicated by arrow J to receive heat from and cool the prime mover. Heated water-antifreeze from the prime mover travels as indicated by arrow K into conduit K and into the plenum formed on rear portion 11 by plate 65 and member 67. The water-antifreeze in the plenum on the rear portion travels into conduits 30 to 36.

In operation, when a water-antifreeze solution (or other coolant) travels through conduits 30 to 36 and 20 to 26 in the manner described above, air traveling through portions 10 and 11 absorbs heat from fins 40 to 51 and functions to absorb heat from the solution. The radiator functions to cool more efficiently water-antifreeze solution than does a conventional radiator having a comparable rate of through flow and a thickness equivalent to that obtained by adding the distance indicated by arrows 61 to the distance indicated by arrows 63. The radiator of the invention more efficiently cools a water-antifreeze solution than does a radiator which is constructed in a manner identical to that shown in FIGS. 1 and 2 except that the space indicated by arrows 62 is eliminated such that portions 10 and 11 are adjacent and contacting one another.

Figure 4:
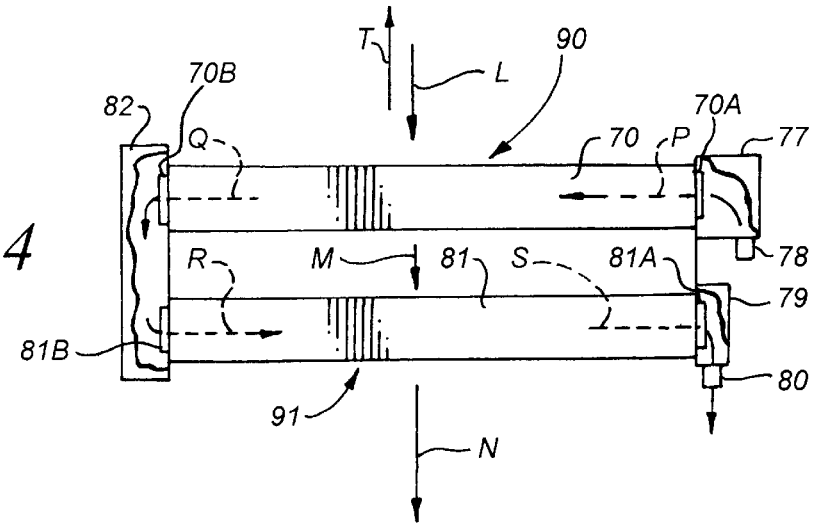
FIG. 4 is a top view illustrating a vehicle radiator constructed in accordance with an alternate embodiment of the invention; and, FIG. 5 is a perspective view illustrating a portion of one of the cores of the radiator of FIG. 4.
Figure 5:
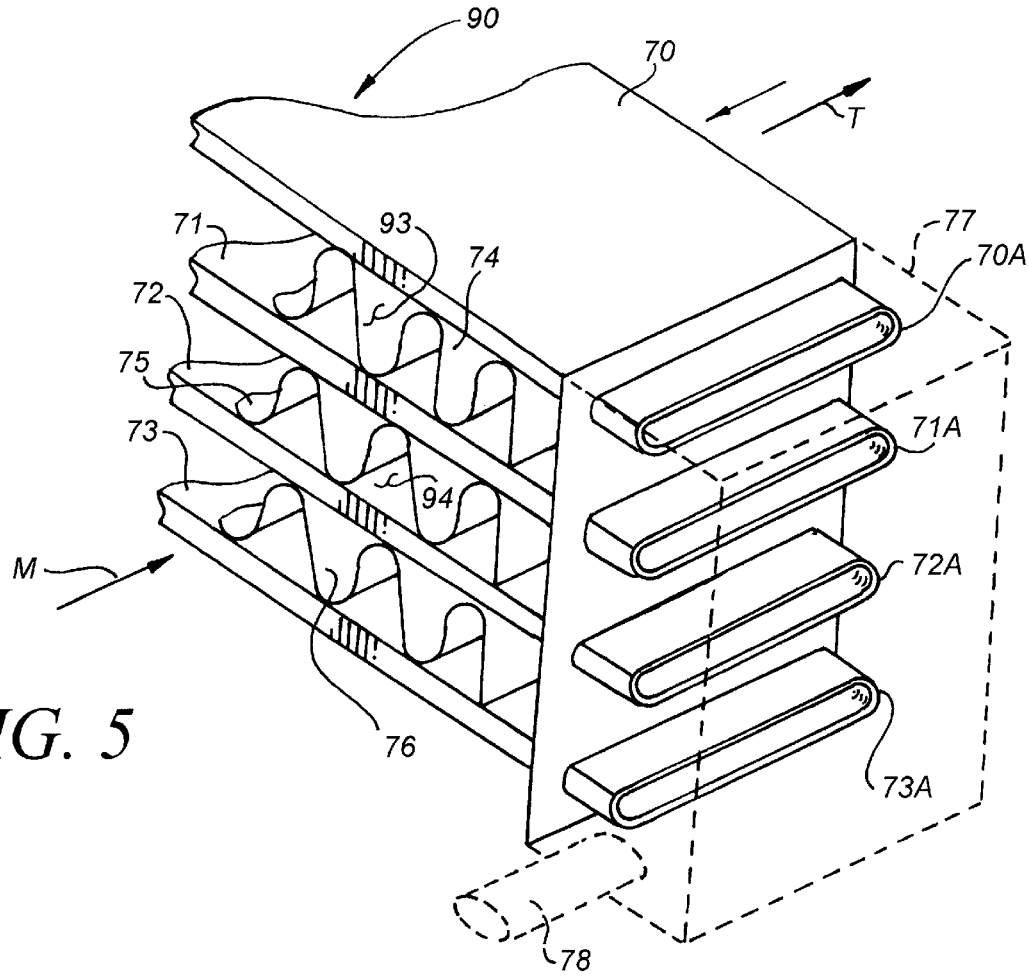

Another embodiment of the invention is illustrated in FIGS. 4 and 5. The radiator in FIG. 4 includes cores 90 and 91, inlet tank 77 connected to one end of core 90, tank 82 connected to the other end of core 90 and to one end of core 91, and outlet tank 79 connected to the other end of core 91. The construction of cores 90 and 91 is, for sake of this example, identical. The constructions of each core 90, 91 can, if desired, be different from that of the other core.

The construction of a portion of core 90 is illustrated in FIG. 5 and includes a plurality of relatively "flat" hollow parallel tubes 70 to 73 each having a first inlet end 70A to 73A, respectively. Each tube 70 to 73 is identical in shape and dimension. The outlet ends of tubes 70 to 73 are not illustrated in FIG. 5, although the outlet end 70B of tube 70 can be seen in FIG. 4. Serpentine heat transfer member 74 interconnects the adjacent, spaced apart tube pair 70, 71. Serpentine heat transfer member 75 interconnects the adjacent, spaced apart tube pair 71, 72. Serpentine heat transfer member 76 interconnects the adjacent, spaced apart tube pair 72, 73.

The top tube 81 of core 91 can be seen in FIG. 4 and includes an inlet end 81B and outlet end 81A.

Coolant enters the radiator of FIG. 4 by flowing through conduit 78, into inlet tank 77, and through inlet ends 70A to 73A into tubes 70 to 73 in the manner indicated by arrow P. The coolant flows through tubes 70 to 73 and exits through the outlet ends of tubes 70 to 73 into tank 82 in the manner indicated by arrow Q. The coolant flows from tank 82 through the inlet ends of the tubes 81 et al. comprising core 91 in the manner indicated by arrow R. The coolant flows through tubes 81 et al. and exits the outlet ends of tubes 81 et al. into tank 79 and through conduit 80 in the manner indicated by arrow S. When the vehicle carrying the radiator is moving in the direction of arrow T in FIG. 4, air is forced in the direction of arrow L into and through openings 93, 94 which are bounded by and extend through serpentine members 74 to 76 in core 90. Or, a fan or other means can cause air to flow through core 90. Air exiting core 90 travels toward core 91 in the direction of arrow M. Air leaving core 90 ordinarily is subject to turbulent flow conditions but gradually resumes laminar flow as it nears core 91. The distance between parallel cores 90 and 91 must be great enough to permit air exiting core 90 to resume laminar flow. The distance between cores 90 and 91 is presently in the range of about 0.75 to six inches. The shape and dimension of serpentine members 74 to 76 is critical in determining the minimal allowable distance between cores 90 and 91. Members 74 to 76 which produce a strong turbulent air flow exiting core 90 require a greater distance between cores 90 and 91 in order for the air to resume laminar flow before the air enters core 91.

Air entering core 91 in the direction indicated by arrow M passes therethrough and exits in the direction of travel indicated by arrow N. Air exiting core 91 experiences turbulent flow and then, as the air exiting core 91 travels away from core 91, begins to approach or experience laminar flow.

Coolant flows through cores 90 and 91 in the manner described while the vehicle in which the radiator is mounted moves in the direction indicated by arrow T in FIGS. 4 and 5. Heated coolant from the vehicle engine enters inlet tank in the direction of arrow P. Cooled coolant which exits through outlet tank 79 in the direction of arrow S travels back to the vehicle engine to receive heat from and cool the engine.

Having described my invention in such terms as to enable those skilled in the art to understand and practice it, and having identified the presently preferred embodiments thereof, I claim:

1. In combination with a motor vehicle, the motor vehicle including a frame, a prime mover mounted on the frame, a coolant, and a circulation system for moving the coolant adjacent the prime mover to absorb heat from the prime mover, the improvement comprising a radiator for receiving coolant from said circulation system and removing heat from the coolant, the radiator comprising (a) a first heat transfer section to receive coolant from the circulation system, said first section including at least one conduit for receiving coolant and a plurality of spaced apart fins contacting and extending outwardly from said conduit, said heat transfer section including a plurality of spaces each intermediate an adjacent pair of said fins, said fins including a first side and a second side and being shaped and dimensioned such that air flowing in said first side passes through said spaces, by said conduit and exits said spaces from said second side in turbulent flow; and, (b) a second heat transfer section in fluid communication with said first heat transfer section to receive coolant from said first heat transfer section, said second heat transfer section including at least one conduit for receiving coolant and a plurality of spaced apart fins contacting and extending outwardly from said conduit said second heat transfer section including a plurality of spaces each intermediate an adjacent pair of said fins in said second heat transfer section, said fins of said second heat transfer section including a first side spaced a selected distance apart from said second side of said fins of said first heat transfer section; said second section being spaced apart from said first section a distance in the range of three-quarters of an inch to six inches such that air exiting said spaces in said first heat transfer section and said second side of said first heat transfer section (c) flows toward and into said spaces in said second heat transfer section, and (d) assumes laminar flow prior to entering said spaces in said second heat transfer section.

2. A method of transferring heat in a motor vehicle, the motor vehicle when operated normally traveling in a selected forward direction (T) of travel and including a frame, a prime mover mounted on the frame to provide when operated motive power to move said vehicle, a coolant, and a circulation system for moving the coolant adjacent the prime mover to absorb heat from the prime mover, the method comprising the steps of (a) providing a radiator for receiving coolant from said circulation system and removing heat from the coolant, said radiator including (i) a first heat transfer section to receive coolant from the circulation system, said first section including at least one conduit for receiving coolant, an inlet tank in fluid communication with and connected to said conduit, and a plurality of spaced apart fins contacting and extending outwardly from said conduit, said heat transfer section including a plurality of spaces each intermediate an adjacent pair of said fins, said fins including a first side and a second side and being shaped and dimensioned such that air flowing in said first side in a secondary direction of travel opposite the selected direction of travel (T) passes through said spaces, by said conduit and exits said spaces from said second side in turbulent flow, (ii) a second heat transfer section in fluid communication with said first heat transfer section to receive coolant from said first heat transfer section, said second heat transfer section including at least one conduit for receiving coolant, an outlet tank connected to said conduit of said second heat transfer section, and a plurality of spaced apart fins contacting and extending outwardly from said conduit, said second heat transfer section including a plurality of spaces each intermediate an adjacent pair of said fins in said second heat transfer section, said fins of said second heat transfer second including a first side spaced a selected distance apart from said second side of said fins of said first heat transfer section, said second section being spaced apart from said first section a distance in the range of three-quarters of an inch to six inches such that air exiting said spaces in and exiting out of said second side of said first heat transfer section flows into said open space between said first and second heat transfer sections, flows toward and into said spaces in said second heat transfer section, and begins laminar flow prior to entering said spaces in said second heat transfer section;

mounting said radiator on said vehicle to receive coolant from said circulation system such that (i) said fins of said first heat transfer section and said fins of said second heat transfer section are generally parallel to one another and are generally perpendicular to said selected forward direction of travel of said vehicle, and (ii) said outlet tank is spaced apart from said inlet tank;

(c) operating said prime mover to cause said vehicle to move in said selected forward direction of travel (T) such that the movement of said vehicle causes air to flow (i) into said first side of said fins of said first heat transfer section in said secondary direction of travel, through said spaces in said first heat transfer section, and turbulently out of said second side of said fins of said first heat transfer section, (ii) from said first heat transfer section into said open space between said first and second heat transfer sections and into said spaces in said second heat transfer section, and (iii laminarly prior to entering said spaces in said second heat transfer section.

* * * * *